US006681431B2

(12) United States Patent
Zivanovic et al.

(10) Patent No.: US 6,681,431 B2
(45) Date of Patent: Jan. 27, 2004

(54) ADJUSTABLE ANCHOR BEARING A CIVIL ENGINEERING STRUCTURE

(75) Inventors: Ivica Zivanovic, Arnouville (FR); Vincent Morisseau, Paris (FR)

(73) Assignee: Freyssinet International (STUP) (FR)

( * ) Notice: Subject to any disclaimer, the term of this patent is extended or adjusted under 35 U.S.C. 154(b) by 117 days.

(21) Appl. No.: 10/031,804

(22) PCT Filed: Mar. 12, 2001

(86) PCT No.: PCT/FR01/00727

§ 371 (c)(1),
(2), (4) Date: Nov. 12, 2001

(87) PCT Pub. No.: WO01/68986

PCT Pub. Date: Sep. 20, 2001

(65) Prior Publication Data

US 2002/0104175 A1 Aug. 8, 2002

(30) Foreign Application Priority Data

Mar. 13, 2000 (FR) ..... 00 03171

(51) Int. Cl.[7] ..... E01D 19/16
(52) U.S. Cl. ..... 14/22
(58) Field of Search ..... 14/22, 18, 19, 14/20, 21, 23, 14

(56) References Cited

U.S. PATENT DOCUMENTS

| | | | | | |
|---|---|---|---|---|---|
| 744,406 | A | * | 11/1903 | Riblet | 104/200 |
| 1,293,383 | A | * | 2/1919 | Eaton | 14/22 |
| 1,714,187 | A | * | 5/1929 | Pacy | 14/14 |
| 1,811,153 | A | * | 6/1931 | Reilly | 14/22 |
| 3,604,361 | A | | 9/1971 | Harbert et al. | |
| 6,138,309 | A | * | 10/2000 | Tadros et al. | 14/22 |

FOREIGN PATENT DOCUMENTS

| | | | | | |
|---|---|---|---|---|---|
| DE | 2002781 | | | 7/1971 | |
| FR | 1 056 325 | | | 2/1954 | |
| FR | 2806106 | | * | 3/2000 | E01D/19/14 |
| GB | 1173005 | | | 12/1969 | |
| GB | 2364330 | A | * | 1/2002 | E01D/19/16 |
| JP | 6026016 | A | * | 1/1994 | E01D/21/04 |
| WO | WO 01/68986 | A1 | * | 9/2001 | E01D/19/16 |

* cited by examiner

*Primary Examiner*—Robert E. Pezzuto
*Assistant Examiner*—Alexandra K. Pechhold
(74) *Attorney, Agent, or Firm*—Cantor Colburn LLP

(57) ABSTRACT

An adjustable anchor for a cable bearing a civil engineering structure, comprising two anchoring parts designed to be fixed to a cable and to the civil engineering structure. These anchoring parts are coupled by a linking part including two threaded ends with inverted threads which are screwed to the two anchoring parts.

9 Claims, 2 Drawing Sheets

ADJUSTABLE ANCHOR BEARING A CIVIL ENGINEERING STRUCTURE

FIELD OF THE INVENTION

The present invention is related to adjustable anchors for cables bearing civil engineering structures, to civil engineering structures including such anchors, and to methods for adjusting such anchors.

DESCRIPTION OF THE RELATED ART

Adjusting the length and/or tension of civil engineering structure cables, for example of suspension bridge hangers or possibly guys, is generally a complex operation and tricky to implement.

SUMMARY OF THE INVENTION

The purpose of the present invention is therefore to propose an anchor for a civil engineering structure suspension cable that enables such an adjustment to be made simply, economically and safely.

For this purpose, according to the invention, an adjustable anchor for a cable bearing a civil engineering structure comprises:

- a first anchoring part designed to be fixed to the cable and including a first thread centered on a longitudinal axis,
- a second anchoring part fitted, with some play along said longitudinal axis, onto a support designed to be fixed to the civil engineering structure, the second anchoring part including a second thread in the reverse direction to the first thread, said second thread being centered on said longitudinal axis and arranged toward the first thread,
- and a linking part including first and second threaded ends complementary to the first and second threads and co-operating by screwing (preferably with play, but not necessarily) with these.

Thanks to these arrangements, the length and/or tension of the cable can easily be adjusted:

- by bringing the first anchoring part and the support closer to one another at least partially by means of an adjustment device,
- then by turning the linking part so as to screw it or unscrew it in relation to both anchoring parts, which brings the two anchoring parts closer together or farther apart from one another and therefore produces an effect equivalent to a shortening or to a lengthening of the cable.

To shorten the cable, one generally begins by substantially taking up all the play between the first anchoring part and the support in order then to be able to move the second anchoring part toward said second anchoring part, while to lengthen the cable, one generally begins by moving the second anchoring part very slightly toward the support so as then to be able to move the first anchoring part toward said support by unscrewing the linking part.

It will be noted that during this adjustment, the first and second anchoring parts are never uncoupled from the support, which confers great safety in use upon the adjustable anchor according to the invention.

In preferred embodiments of the invention, recourse may further be made to one and/or another of the following arrangements:

- the play between the second anchoring part and the support is greater than 3 mm along the longitudinal axis;

- the second anchoring part is a clevis that comprises two flanges arranged on either side of the support, the two flanges and the support being traversed by a pin perpendicular to the longitudinal axis, play being allowed between the pin and at least one element chosen from the clevis and the support;
- the two flanges of the clevis have oblong holes respectively arranged in mutual correspondence in such a way as to create the play between the pin and the clevis;
- the support further includes a mounting hole perpendicular to the longitudinal axis, which is arranged beyond the flanges of the clevis and which is adapted to receive an additional temporary pin: this additional pin is thus used as the engagement point of the adjustment tool designed to bring the first anchoring part at least partially closer to the support.

Moreover, the object of the invention is also a civil engineering structure comprising a suspended part that is connected to at least a cable via an adjustable anchor as defined above.

Finally, the object of the invention is also a method for adjusting an anchor such as that defined above by means of an adjustment tool including first and second parts and activation means for bringing them closer to one another, this method comprising the following steps:

- fixing the first part of the adjustment tool to the first anchoring part,
- fixing the second part of the adjustment tool to an integral element of the support,
- bringing the first anchoring part of said support closer in order to take up the play at least partially between the second anchoring part and said support,
- and turning the linking part around the longitudinal axis so as to adjust the distance between the first and second anchoring parts to a desired value.

Advantageously, the second part of the adjustment tool can be fixed to a pin engaged in a mounting hole of the support perpendicularly to the longitudinal axis, or to a pin that traverses both the second anchoring part and the support perpendicularly to the longitudinal axis.

BRIEF DESCRIPTION OF THE DRAWINGS

Other characteristics and advantages of the invention will appear in the course of the following description of one of its embodiments, given as a non-restrictive example, compared with the attached drawings.

In the drawings.

DETAILED DESCRIPTION OF THE PREFERRED EMBODIMENT

The same references on the various figures designate the same or similar elements.

Figure 1:
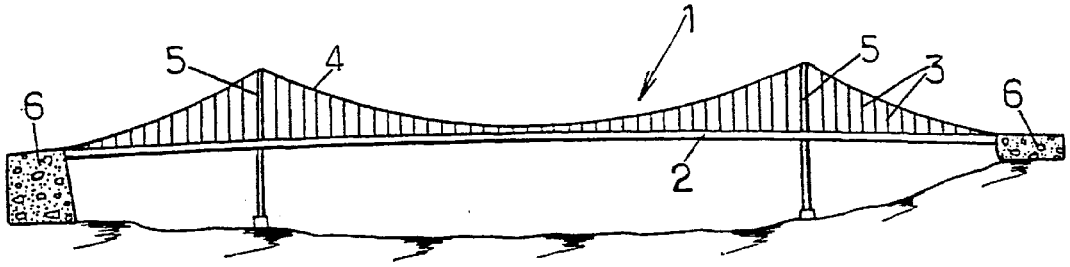
- FIG. 1 is a diagrammatic view of a suspension bridge whose hangers may be equipped with adjustable anchors according to the invention.

FIG. 1 represents a suspension bridge 1 including a deck 2 that is borne by hangers 3 generally connected to two parallel suspension cables 4 passing above two pillars 5 and whose ends are anchored in two abutments 6.

Figure 2:
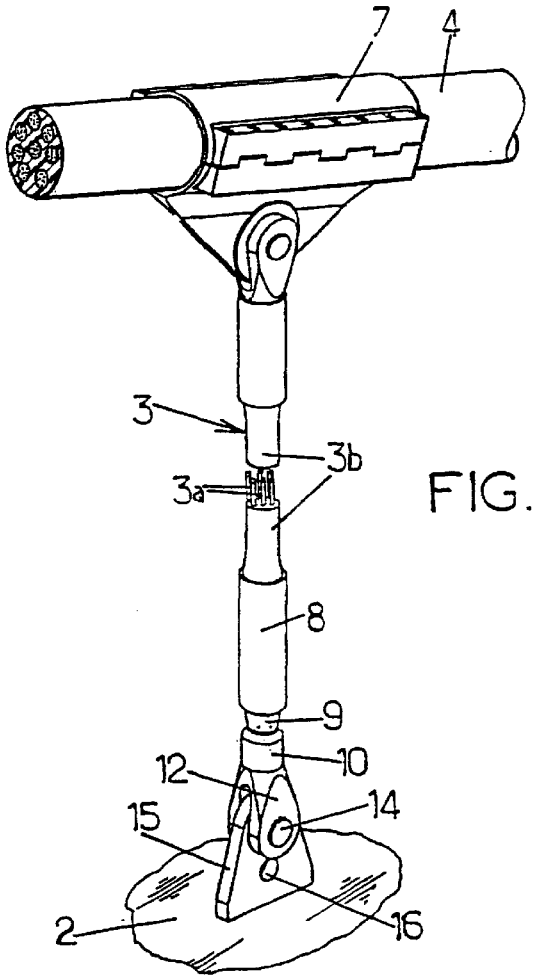
- FIG. 2 is a partial perspective view representing one of the hangers of the bridge in FIG.
Figure 3:
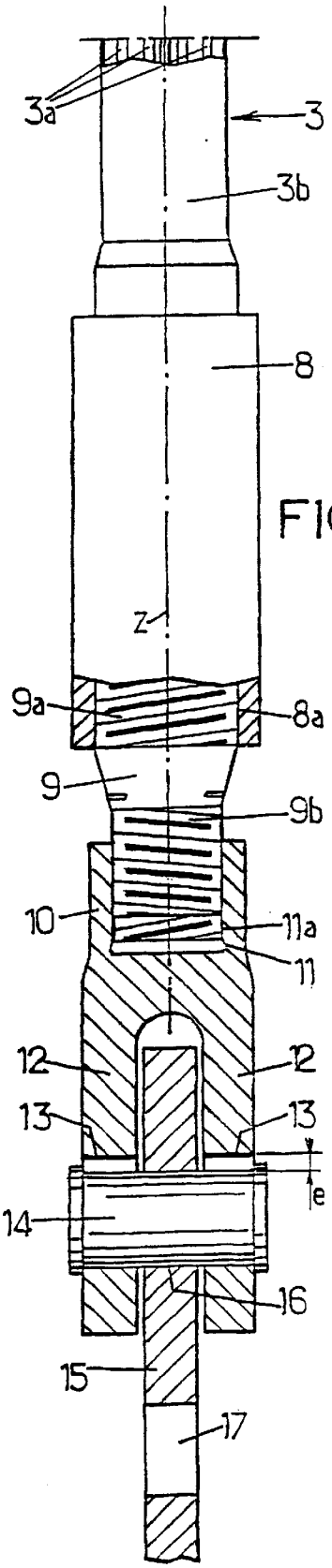
- FIG. 3 is a partial vertical cross-sectional view of the lower anchor of the hanger in FIG. 2, during normal use of this hanger.

As shown in FIGS. 2 and 3, each hanger 3 may include for example a plurality of parallel steel strands 3*a* (or possibly a single strand of larger diameter) surrounded by a plastic sheath 3*b*. The strands 3*a* that form the hanger are anchored individually, in an intrinsically known fashion, to a clamping collar 7 fixed to the suspension cable 4 and in an anchor pipe 8 fixed adjustably to the deck 2, so as to be able to adjust the length of the hanger 3 in order to respect the predetermined metric measurements of the suspension cable 4.

For this purpose, the anchor pipe 8 is open at the bottom and includes an internal thread 8*a* made in a first direction and centered on a vertical axis Z along which the hanger 3 extends.

A steel linking part 9 is screwed into the thread 8*a*, preferably with play, which includes at one of its ends a male thread 9*a* corresponding to the female thread 8*a* of the anchor pipe.

Moreover, the lower end of the linking part 9 includes a male thread 9*b* which is also centered on axis Z and which is made in the reverse direction from the above-mentioned threads 8*a* and 9*a*.

This thread 9*b* is screwed, preferably with play, into a blind hole 11 arranged at the upper end of a steel clevis 10 and provided with a female thread 11*a* corresponding to the above-mentioned thread 9*b*.

This clevis 10 includes two parallel flanges 12 in which two oblong holes 13 are arranged respectively in mutual correspondence, the oblong hole being elongated in the direction of the above-mentioned Z axis.

A horizontal pin 14 is engaged in the oblong holes 13 of the flanges 12, which traverses a first hole 16 arranged in a steel support 15.

The support 15 is integral with the deck 2 of the bridge, and in the example shown, it further includes a second transverse hole 17 arranged under the clevis 10.

Figure 4:
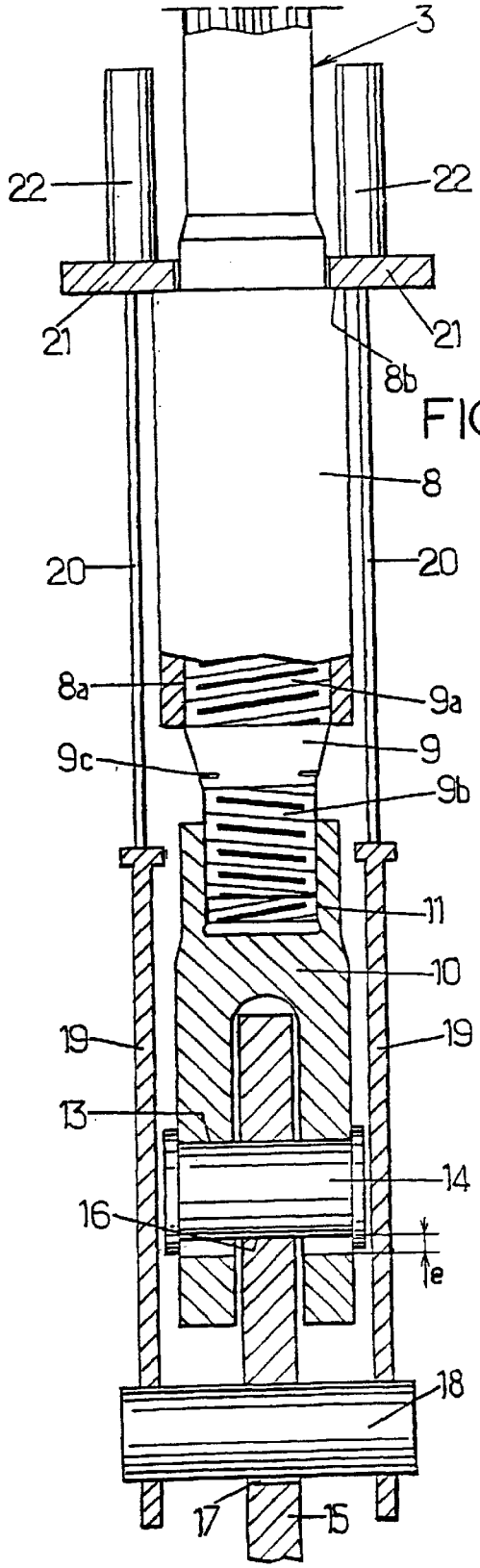
- and FIG. 4 is a similar view to FIG. 3, showing the hanger anchor being adjusted.

To adjust the length of the hanger 3, a tool can be used such as that represented in FIG. 4, which comprises:

an additional horizontal pin 18 that is engaged in the hole 17 of the support 15, two flanges 19 each traversed by the pin 18 and made secure with two tension bars 20 extending upward to a backing plate 21, for example a U-shaped backing plate that is engaged around the hanger 3 on an upper shoulder 8*b* formed by said anchor 8, and cylinders 22 which are adapted to exert a pull on each of the tension bars 20 respectively.

Thanks to this adjustment tool, when the cylinders 22 exert a pull on the pull rods 20 and the flanges, the anchor pipe 8 can be brought closer to the support 15 thus taking up all or part of the play e that existed initially between the upper end of the oblong holes 13 of the clevis 10 and the pin 14. This play e is generally at least equal to 3 mm, and is preferably between 10 and 50 mm.

When the cylinders 22 have taken up all to the part of this play e, the linking part 9 can be turned on itself, especially thanks to radial blind holes 9*c*, arranged on the periphery of this linking part between the anchor pipe 8 and the clevis 10, in order:

to raise the clevis 10, i.e. to shorten the hanger 3, or on the contrary to lower the clevis 10 if the initial play e has only been partially taken up, which enables the hanger 3 to be lengthened.

When the hanger 3 has to be shortened or lengthened by a length greater than the play e, this operation must be repeated several times.

Possibly, the play e could be provided between the pin 14 and the support 15 by means of an oblong hole arranged in said support 15, or the play e could be obtained both by a play between the pin 14 and the support 15 and a play between said pin and the clevis 10. Possibly, the play e could be obtained in all cases by means other than oblong holes, for example by adjusting the shape of the pin 14 (for example, diameter of the pin 14 less than the diameter of the hole or holes that it traverses).

It will be noted that as a variant, the flanges 19 of the adjustment tool could where necessary be fixed on the pin 14, or on any other part of the support 15 or of the deck 2 of the bridge. In the case where the flanges 19 are fixed on the pin 14, a pin 14 of larger diameter and greater length than that shown would be used in preference. In addition, in this case, the play e must be provided between the pin 14 and the clevis 10, the possible play between said pin and the support 15 being ineffective.

What is claimed is:

1. Adjustable anchor for a cable bearing a civil engineering structure comprising:

a first anchoring part designed to be fixed to the cable and including a first thread centered on a longitudinal axis, a rigid support designed to be fixed to the civil engineering structure, a second anchoring part fitted in sliding engagement onto said rigid support, with some play along said longitudinal axis, said second anchoring part including a second thread of reverse direction to the first thread, said second thread being centered on said longitudinal axis and arranged toward the first thread, and a linking part including first and second threaded ends complementary to the first and second threads and co-operating by screwing with said first and second threads;

wherein the second anchoring part is a clevis that includes two flanges arranged on either side of the support, the two flanges and the support being traversed by a pin perpendicular to the longitudinal axis, the play being left between the pin and at least one element chosen from the clevis and the support.

2. Adjustable anchor according to claim 1, wherein the two flanges of the clevis have oblong holes respectively arranged in mutual correspondence is such a way as to create the play between the pin and the clevis.

3. Adjustable anchor according to claim 1, wherein the support further includes a mounting hole perpendicular to the longitudinal axis, which is arranged beyond the flanges of the clevis and which is adapted to receive an additional temporary pin.

4. Civil engineering structure comprising:

a suspended part which is connected to at least a cable via an adjustable anchor, the adjustable anchor including:

a first anchoring part fixed to the cable and including a first thread centered on a longitudinal axis, a rigid support fixed to the civil engineering structure, a second anchoring part fitted in sliding engagement onto said rigid support, with some play along said longitudinal axis, said second anchoring part including a second thread of reverse direction to the first thread, said second thread being centered on said longitudinal axis and arranged toward the first thread, and a linking part including first and second threaded ends complementary to the first and second threads and co-operating by screwing with said first and second threads.

5. Civil engineering structure according to claim 4, wherein the play between the second anchoring part and the support is greater than 3 mm along the longitudinal axis.

6. Method for adjusting an anchor, by means of an adjustment tool comprising first and second parts and activation means for bringing said first and second parts closer to one another, said method comprising the following steps:

fixing the first part of the adjustment tool to a first anchoring part, fixing the second part of the adjustment tool to an integral element of a support, bringing the first anchoring part of said support closer in order to take up the play at least partially between a second anchoring part and said support, and turning a linking part around a longitudinal axis so as to adjust a distance between the first and second anchoring parts to a sired value.

7. Method according to claim 6, wherein the second part of the adjustment tool is fixed to a pin engaged in a mounting hole of the support perpendicularly to the horizontal axis.

8. Method according to claim 6, wherein the second part of the adjustment tool is fixed to a pin that traverses both the second anchoring part and the support perpendicularly to the horizontal axis.

9. Civil engineering structure comprising:

a slob anchored to an abutment;

a suspended part which is connected to at least a cable via an adjustable anchor, the adjustable anchor including:

a first anchoring part fixed to the cable and including a first thread centered on a longitudinal axis, a rigid support fixed to the slab, a second anchoring part fitted in sliding engagement onto said rigid support, with some play along said longitudinal axis, said second anchoring part including a second thread of reverse direction to the first thread, said second thread being centered on said longitudinal axis and arranged toward the first thread, and a linking part including first and second threaded ends complementary to the first and second threads and co-operative by screwing with said first and second threads.

* * * * *